United States Patent [19]

Gundlach

[11] 3,967,818

[45] July 6, 1976

[54] DUPLICATING SYSTEM

[75] Inventor: Robert W. Gundlach, Victor, N.Y.

[73] Assignee: Xerox Corporation, Stamford, Conn.

[22] Filed: Dec. 16, 1974

[21] Appl. No.: 532,783

[52] U.S. Cl. ..... 270/18; 101/136; 101/232; 101/DIG. 13; 270/58; 355/16

[51] Int. Cl.[2] ..... B41F 13/64

[58] Field of Search ..... 270/4, 12, 18, 58; 101/229–232, 92, 122, 228, DIG. 13, 136; 355/3 R, 3 BE, 16, 20, 23, 26, 24; 271/173, 64

[56] References Cited

UNITED STATES PATENTS

| | | | |
|---|---|---|---|
| 2,548,281 | 4/1951 | Bartholomew | 101/232 |
| 3,267,840 | 8/1966 | Honma | 101/DIG. 13 |
| 3,526,191 | 9/1970 | Silverberg | 101/DIG. 13 |
| 3,619,050 | 11/1971 | Swanke | 355/16 |
| 3,744,790 | 7/1973 | Hoffman | 270/58 |

*Primary Examiner*—J. Reed Fisher
*Assistant Examiner*—A. Heinz

[57] ABSTRACT

A duplicating system for producing collated copy sets from precollated information. The precollated information is stored on a reversibly driven and reversibly developed web member which is driven past a first copy transfer station when moving in a first direction and past a second copy transfer station when driven in a reverse direction. A development station is positioned in the path of the web to develop the precollated information thereon when the web is moving in either direction. Copy sheets are fed by a first transport past the first transfer station to produce copies thereof when the web is moving in a first direction. Copies are fed by a second transport past the second transfer station to produce copies from the developed web member when the web is moved in a reverse direction. The copies are fed to a first copy receiving tray face down when the web is moving in one direction and to a second copy receiving tray face up when the web is moving in a reverse direction. In this manner, two stacks or sets of copies are reproduced in collated order from the precollated information on the web. Upon repeating the steps of the duplicating process additional copy sets in precollated order can be obtained. The web may take the form of a lithographic master, a magnetic tape, flexographic master or a xeroprinting master.

5 Claims, 1 Drawing Figure

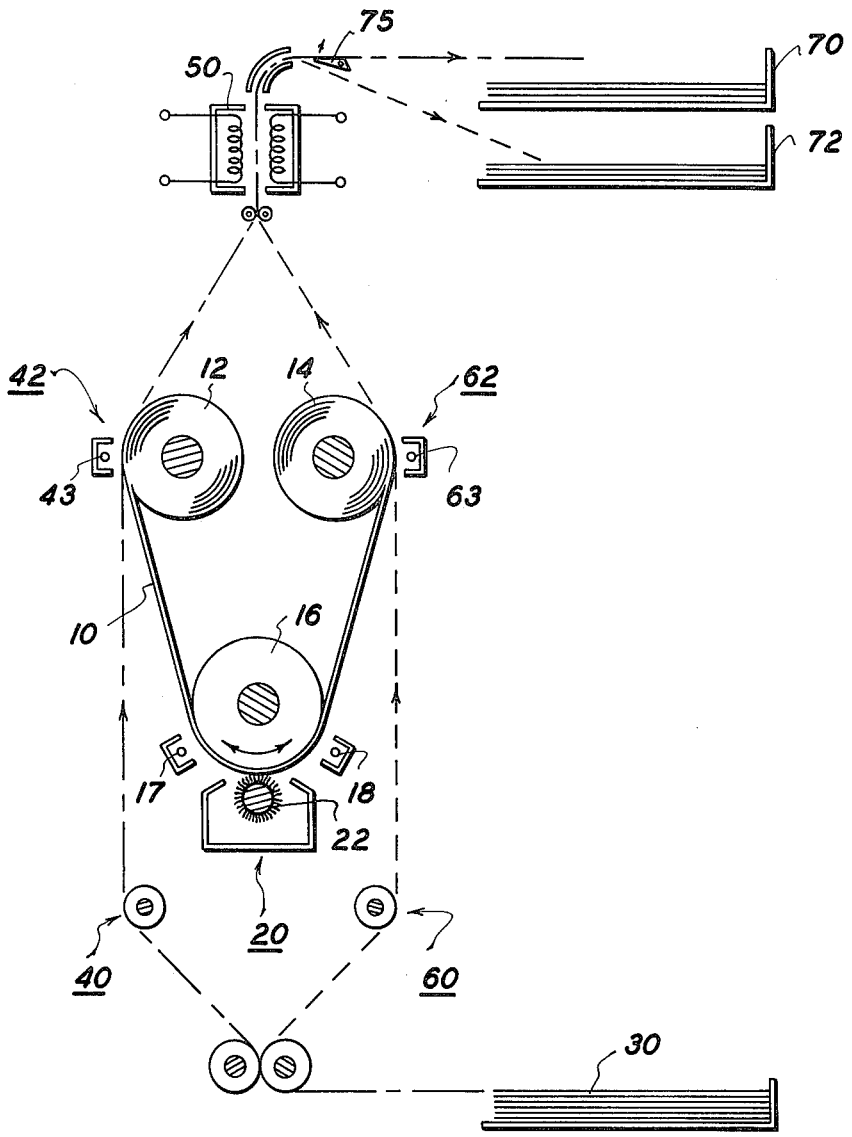
75
50
70
72
42
12
14
62
43
63
10
16
17
18
22
20
40
60
30

DUPLICATING SYSTEM

This application relates to a duplicating method and apparatus for producing collated copy sets from precollated information.

In the past, copier duplicator systems producing copies from original documents have required sorting bins or the like for collating the copy sets produced. These mechanical sorting bins are complex in their operation and are space consuming and add an additional cost for the duplicator or the copier duplicator system. Also, with sorting bins no single set or book of pages is complete until all but the last page for all books are duplicated.

The present invention is for a new and improved duplicating method and apparatus which can produce collated copy sets from a precollated information input without the necessity of mechanical sorting devices or the like.

It is therefore an object of the invention to improve copier duplicating systems.

It is another object of the present invention to produce collated copy sets from precollated information efficiently and without the necessity of mechanical sorting bins.

It is another object of the present invention to enable the production of high speed quality copies in collated order reliably and efficiently.

The invention herein is accomplished generally speaking by using an intermediate buffer in the form of a scroll or the like as a master which is run forwards and backwards to produce a copy run in each direction. The copies produced from a run in the first direction are delivered to a receiving tray face down while the copies produced from the second run are received to a second receiving tray face up. By repeating the steps copy sets in collated order are produced from a precollated information on the master. It will be seen that in such a system each set or book of pages is completed before the next set is begun.

A better understanding of the invention can be had from the following detailed description which should be read in conjunction with the accompanying FIGURE which shows a schematic of the duplicating system components in accordance with the present invention.

Referring to the FIGURE there is shown a master scroll 10 which is mounted on spools 12 and 14 and which is driven by rollers 16 in reverse directions on each of the spool numbers 12 and 14. A master scroll 10 is used as an intermediate buffer and can be in the form of lithographic master web, a flexographic master, a magnetic tape, or an electrostatic recording surface such as a xeroprinting master. A description of the xeroprinting master is described in the text *Electrophotography* by Schaffert on page 116 and in U.S. Pat. No. 2,576,047. The xeroprinting master is shown in the embodiment of the FIGURE for purposes of illustration.

Corotrons 17 and 18 are positioned to apply charge to the image areas of scroll 10 prior to development by a magnetic brush developer as will be explained. It will be appreciated that the charge is uniformly deposited over the scroll surface but is retained selectively in the image areas. It will be further understood that corotron 17 is activated when the scroll is driven from left to right looking at the FIGURE and corotron 18 is activated when the scroll is driven in the reverse direction.

A development station 20 is positioned in the path of the scroll 10 for applying developer material which is an electrostatic toner material applied by a magnetic brush 22 including magnetic carrier beads held on a magnetic roller as described in U.S. Pat. Nos. 3,015,305 and 3,219,014.

The toner materials can be any suitable pigmented or dyed electroscopic toner material and may be employed with carriers as is known by those skilled in the art. Typical toner materials include: gum copal; gum sandarac, rosin; cumaroneinden resin; asphaltum; phenylformaldehyde resins; rosin modified phenylformaldehyde resins; epoxy resins; polyethylene resins; polyester resins and mixtures thereof. The particular toner material to be employed usually depends upon the separation of the toner materials from the carrier beads in the triboelectric series and whether a negatively or positively charged image is to be developed. Among the patents describing electroscopic toner compositions are U.S. Pat. No. 2,659,670 to Copley; U.S. Pat. No. 2,753,308 to Landrigan; U.S. Pat. No. 3,079,342 to Insalaco; U.S. Pat. No. Re-Issue 25,136 to Carlson, and U.S. Pat. No. 2,788,288 to Rheinfrank et al. These toners generally have an average particle diameter between 1–30 microns. A toner comprising styrene N-butyl methacrylate copolymer polyvinylbutyral and carbon produced by the method disclosed by Insalaco in Example 1 of U.S. Pat. No. 3,079,342 is preferred because of its excellent triboelectric qualities and its deep black color.

Copy sheets fed from a stack 30 along a transport generally designated 40 which has a transfer station 42 at which the developed image is transferred to the copy sheet by activating a corotron 43. The copy bearing the transferred image is then advanced past a fuser 50 which serves to fuse a toner material onto the copy sheet. A second transport generally designated 60 serves to transport copy sheets past a second transfer station 62 where the images are transferred by activating a corotron 63 to transfer the developed image to the copy sheet when the master scroll 10 is moving in a reverse direction. Transports 40 and 60 can be any suitable type transport, such as, vacuum belts or pinch rolls or combinations thereof as is well known by those skilled in the art. The sheets paths are joined together before the fuser 50 and are advanced to either of a pair of receiving trays 70 and 72. Positioned before the receiving trays in the sheet path is a gate member 75 which is pivotable and is actuated in any suitable manner as by a solenoid serves to direct the copy sheets into either tray 70 or 72 depending upon the direction or movement of the scroll 10.

In operation, it will be appreciated that when the master scroll is moving with the information in the usual sequence or one, two, three, four . . . that the copies produced are delivered to tray 70 face down. Alternatively, after the last copy has been produced and the movement of the scroll 10 and the development or inking device is reversed, the copies produced are advanced to tray 72 face up, it being understood that the order will appear as . . . four, three, two, one. By reversing the master scroll direction and repeating the steps mentioned, it will be appreciated that collated sets or books are produced from precollated information on the master scroll 10. It will be noted that copy sheets are transported by either transport 40 or transport 60 at one time and that the machine control activates the proper transport and gate 75 when scroll 10 is running in the proper direction. It will be appreciated that the above described invention provides a new and improved duplicating method and apparatus in which collated copy sets are produced from precollated information without the use of complicated mechanical sorting bins or the like.

It will be obvious to those skilled in the art that the duplicating method and apparatus of the invention described above only requires that the master scroll and developer or inking system have the capability of operating in either or two directions. For example, in lithographic printing the master first advances past a damping roll followed by an inking roll. Thus, when the scroll is reversed the proper sequence of the damping and inking rolls must be provided.

In the case of flexographic printing the scroll is in the form of a rubber letterpress master which is inked by direct contact with an inking roll. Transfer is accomplished by direct pressure contact with the copy sheet.

It will be appreciated that a fuser is not necessary for lithographic or flexographic printing.

While there has been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. In a duplicating apparatus for producing collated copy sets from precollated information in the form of master information storage means including a web adapted to move in reverse directions comprising:

reversible drive means for moving an information storage web along a predetermined path in a preselected direction past first and second copy transfer stations, first transport means for transporting copy sheets past a first transfer station adjacent the path of said web to receive a developed image thereon from said web when the web is moved in a first direction, second transport means for transporting copy sheets past a second transfer station for receiving a developed image thereon from said web when the web is moved in a reverse direction, first and second receiving trays positioned to receive copy sheets image face up or image face down from either the first or second transfer stations depending upon the direction of movement of the web, and control means operable to advance copy sheets selectively into a one of said first or second trays depending upon the direction of movement of the web.

2. Apparatus according to claim 1 wherein said web is in the form of a lithographic master.

3. Apparatus according to claim 1 wherein said web is a flexographic master material.

4. Apparatus according to claim 1 wherein said web is in the form of an electrostatic recording material which is developed by electroscopic toner.

5. A method of producing collated sets of precollated information comprising the steps of transporting a web bearing precollated graphic information in a first direction, developing the web by contact with a rotatable member, transferring developed images onto copy sheets at a first transfer station, and directing sheets in sequence to a first tray image face down and then reversing the direction of the web and rotatable member, and transferring developed images onto copy sheets at a second transfer station, and directing the sheets from the second transfer station to a second tray image face up and repeating the aforementioned steps to produce collated copy sets for movement of the web in each direction.

* * * * *